United States Patent [19]

Hirota

[11] 4,413,594

[45] Nov. 8, 1983

[54] METHOD AND APPARATUS FOR STARTING AN ALCOHOL ENGINE

[75] Inventor: Toshio Hirota, Yokosuka, Japan

[73] Assignee: Nissan Motor Company, Limited, Yokohama, Japan

[21] Appl. No.: 340,276

[22] Filed: Jan. 18, 1982

[30] Foreign Application Priority Data

Mar. 19, 1981 [JP] Japan ..... 56-38734

[51] Int. Cl.[3] ..... F02B 43/08; F02M 13/06

[52] U.S. Cl. ..... 123/3; 123/1 A; 123/179 G; 123/180 AC; 123/576

[58] Field of Search ..... 123/1 A, 2, 3, 179 G, 123/180 AC, 180 R, 575–576

[56] References Cited

U.S. PATENT DOCUMENTS

| | | | |
|---|---|---|---|
| 3,783,841 | 1/1974 | Hirschler, Jr. et al. | 123/2 |
| 4,131,086 | 12/1978 | Noguchi et al. | 123/3 |
| 4,170,200 | 10/1979 | Takeuchi et al. | 123/3 |
| 4,204,511 | 5/1980 | Morris | 123/179 G |
| 4,250,849 | 2/1981 | Takase | 123/179 G |

FOREIGN PATENT DOCUMENTS

| | | | |
|---|---|---|---|
| 2306343 | 10/1976 | France . | |
| W080/01398 | 10/1980 | PCT Int'l Appl. | 123/3 |
| 220291 | 7/1925 | United Kingdom . | |
| 1346702 | 2/1974 | United Kingdom . | |
| 1521224 | 8/1978 | United Kingdom . | |

OTHER PUBLICATIONS

"Automobiltechnische Zeitschrift", vol. 81, No. 6, Jun. 1979, pp. 279–282.

*Primary Examiner*—William A. Cuchlinski, Jr.
*Assistant Examiner*—E. Rollins Cross
*Attorney, Agent, or Firm*—Schwartz, Jeffery, Schwaab, Mack, Blumenthal & Koch

[57] ABSTRACT

In a method and apparatus for starting an alcohol engine equipped with a starting motor, alcohol is converted into a high-temperature gaseous mixture containing a relatively highly volatile substance. The gas is cooled to provide a liquid condensate containing the relatively highly volatile substance. The liquid condensate is supplied to the engine as fuel when the starting motor is in operation.

15 Claims, 3 Drawing Figures

METHOD AND APPARATUS FOR STARTING AN ALCOHOL ENGINE

BACKGROUND OF THE INVENTION

1. Field of the Invention

This invention relates to a method and apparatus for starting an alcohol internal combustion engine.

2. Description of the Prior Art

Internal combustion engines employing alcohol as fuel are difficult to start, because alcohol is hard to vaporize under low-temperature conditions due to its high boiling point as compared to that of gasoline and its high latent heat of vaporization causes the resulting alcohol/air mixture to be substantially cooled. A conventional method of starting an alcohol engine is to crack alcohol into more easily combustible hydrogen and carbon monoxide gases and to supply these gases in addition to alcohol to the engine at starting. However, precise flow control of gaseous fuel may be more difficult than that of liquid fuel.

SUMMARY OF THE INVENTION

Accordingly, it is an object of the present invention to provide a method and apparatus for starting an alcohol engine which converts alcohol into more easily combustible liquid fuel, and supplies it to the engine during starting.

It is another object of the present invention to provide a method and apparatus which reliably starts an alcohol engine.

In a method and apparatus of the present invention for starting an alcohol engine equipped with a starting motor, alcohol is converted into a high-temperature gaseous mixture containing a substance of relatively-high volatility. The gaseous mixture is cooled to provide a liquid condensate containing the relatively highly volatile substance. The liquid condensate is supplied to the engine as fuel when the starting motor is in operation.

The above and other objects, features and advantages of the present invention will be apparent from the following description of a preferred embodiment thereof, taken in conjunction with the drawings.

DESCRIPTION OF THE PREFERRED EMBODIMENTS

Figure 1:
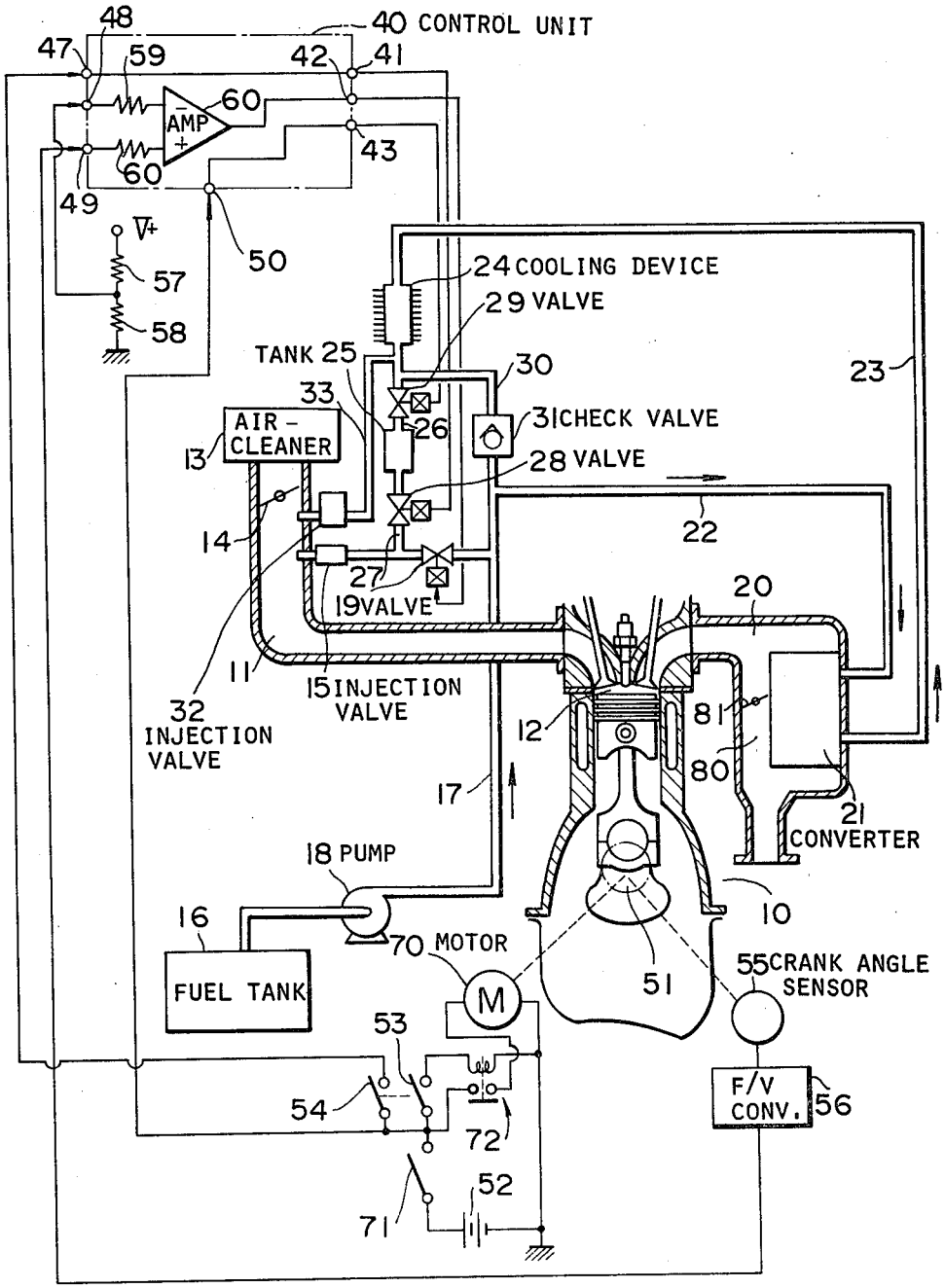
FIG. 1 is a diagram including a partial-sectional view of an alcohol internal combustion engine equipped with a starting apparatus of the present invention.

With reference to FIG. 1, there is shown an internal combustion engine 10 which employs methanol as fuel and is equipped with a starting apparatus of the present invention. The starting apparatus converts methanol into a more easily combustible liquid containing dimethyl ether, and supplies it as fuel to the engine during starting.

The engine 10 has an intake passageway 11 which leads to an engine combustion chamber 12 to supply air to the latter. An air cleaner 13 and a throttle valve 14 are provided in the intake passageway 11 in a conventional manner. The outlet of a fuel injection valve 15 opens into the intake passageway 11 downstream of the throttle valve 14, the inlet thereof being connected to a fuel tank 16 via a main fuel supply passageway 17. The fuel tank 16 contains liquid methanol. A fuel pump 18 is disposed in the passageway 17 to draw methanol from the tank 16 and feed it to the injection valve 15. The injection valve 15 discharges methanol into the intake passageway 11 to produce a air-methanol mixture which is then drawn into the combustion chamber 12. Between the pump 18 and the injection valve 15, an electrically-driven or electromagnetic valve 19 is disposed in the fuel passageway 17 to interrupt the supply of methanol from the pump 18 to the injection valve 15 and thus the engine 10.

The engine 10 has an exhaust passageway 20 connected to the engine combustion chamber 12 to transmit exhaust gas from the chamber 12 to the outside. A converter 21 is disposed in the exhaust passageway 20. The converter 21 includes an enclosed casing and platinum-based catalyst positioned within the casing. The converter 21 is provided with an inlet which is connected via a passageway 22 to the fuel supply passageway 17 downstream of the pump 18 but upstream of the electromagnetic valve 19 to admit methanol into the converter 21 or the inside of the casing thereof. The converter 21 receives heat from exhaust gas, thereby converting liquid methanol into a high-temperature gaseous mixture containing dimethyl ether due to its platinum-catalytic action.

A plurality of passageways may be provided through the converter casing so that engine exhaust can pass through the passageways to increase the efficiency of heating the converter 21. In this case, a spacing or path 80 is preferably provided in the exhaust passageway 20 so that a portion of engine exhaust will bypass the passageways through the converter 21. A valve 81 is preferably provided in the path 80 to control the flow of engine exhaust therethrough and thus the flow through the converter passageways to regulate heat in the converter 21 in response to output signals of a converter-heat sensing device (not shown).

The converter 21 is provided with an outlet which is connected via a passageway 23 to an upper opening, that is, inlet of a cooling device 24 to conduct the high-temperature gaseous mixture from the converter 21 to the cooling device 24. The device 24 cools the introduced gaseous mixture to produce a liquid condensate containing dimethyl ether. A lower opening, that is, outlet of the cooling device 24 leads to an upper opening of a sub-tank 25 through a passageway 26 to supply the liquid condensate to the sub-tank 25. The liquid condensate is stored in the sub-tank 25. A lower opening of the sub-tank 25 is connected via a passageway 27 to the fuel supply passageway 17 upstream of the injection valve 15 but downstream of the electromagnetic valve 19 to supply the liquid condensate to the injection valve 15 and thus the engine 10. An electrically-driven or electromagnetic valve 28 is disposed in the passageway 27 to interrupt the supply of the liquid condensate to the injection valve 15 and thus the engine 10.

An electrically-driven or electromagnetic valve 29 is disposed in the passageway 26 to close the passage 26 or substantially close the upper opening of the sub-tank 25. One end of an overflow passageway 30 is connected to the passageway 26 upstream of the electromagnetic valve 29, the other end thereof being connected to the passageway 22. A check valve 31 is disposed in the overflow passageway 30 in such a manner as to permit fluid flow only from the passageway 26 to the passageway 22. Any liquid condensate which cannot be accommodated in the sub-tank 25 due to the full condition thereof returns to the converter 21 via the overflow passageway 30, check valve 31, and passageway 22. The inlet of a gas injection valve 32 is connected via a passageway 33 to the passageway 26 upstream of the electromagnetic valve 29 and the connection of the overflow passageway 30 to the passageway 26. The outlet of the gas injection valve 32 opens into the intake passage 11 upstream of the fuel injection valve 15 but downstream of the throttle valve 14. The high-temperature gaseous mixture supplied to the cooling device 24 contains non-condensable gases, such as hydrogen and carbon monoxide. These gases remain in gaseous phase even in the cooling environment of the device 24 and are supplied to the engine 10 as a portion of fuel via the passage 33, gas injection valve 32, and the intake passage 11.

A control unit 40 is provided to control the opening and closing of the electromagnetic valves 19, 28, and 29, which are of the on-off type opening when energized and closing when de-energized. The control unit 40 has three output terminals 41, 42, and 43 which are electrically connected to the control terminals of the electromagneic valves 28, 19, and 29 respectively. The control unit 40 has four input terminals 47, 48, 49, and 50.

A conventional starting motor 70 is provided for driving an engine crankshaft 51 during engine starting. A battery 52 is connected across the starting motor 70 via normally-open contacts of a starter relay (magnetic switch) 72 and an ignition switch 71 (key switch). The control winding of the starter relay 72 is connected across the battery 52 via the ignition switch 71 and a starter switch 53. When the switches 53 and 71 are closed, the control winding of the starter relay 72 is thus energized to close the contacts thereof, thereby allowing the starting motor 70 to be also energized. The positive terminal of battery 52 is connected via the switch 71 and a switch 54 to the first input terminal 47 of the control unit 40, and is also connected to the fourth input terminal 50 of the control unit 40 via the switch 71. The negative terminal of battery 52 is grounded. Thus, the closing of the ignition switch 71 causes a high-level signal to be supplied to the fourth input terminal 50. The switch 54 is interlocked with the starter switch 53 in such a way as to close when the starter switch 53 closes. Thus, when the switch 53 is closed to energize in turn the starting motor 70 (provided that the ignition switch 71 is closed), the simultaneous closing of the switch 54 causes a high-level signal to be supplied to the first input terminal 47 of the control unit 40.

A conventional crank angle sensor 55 including a magnetic pick-up cooperates with the engine crankshaft 51 so as to provide an alternating signal, the frequency of which is proportional to engine rotational speed N (RPM). The input terminal of a frequency-to-voltage convertor (F/V convertor) 56 is connected to the crank angle sensor 55 to receive the alternating signal from the crank angle sensor 55. The F/V convertor 56 transforms the alternating signal into a voltage signal, the magnitude of which is proportional to the frequency of the alternating signal and thus engine rotational speed N. The output terminal of the F/V convertor 56 is connected to the third input terminal 49 of the control unit 40 to transmit the voltage signal indicative of engine rotational speed N to the third input terminal 49. One end of a series combination of resistors 57 and 58 is connected to the positive terminal of a stabilized dc power source (not shown), the other end of the series combination and the negative terminal of the power source being grounded. The junction of the resistors 57 and 58 is connected to the second input terminal 48 of the control unit 40 so that a preset constant voltage is applied to the second input terminal 48 as a reference signal corresponding to a predetermined engine rotational speed $N_{ref}$.

The first input terminal 47 of the control unit 40 is directly connected to the first output terminal 41 of the control unit 40. The fourth input terminal 50 of the control unit 40 is directly connected to the third output terminal 43 of the control unit 40. The second input terminal 48 of the control unit 40 is connected to the negative input terminal of an operational amplifier 60 via a resistor 59. The third input terminal 49 is connected to the positive input terminal of the amplifier 60 via a resistor 61. The output terminal of the amplifier 60 is connected to the second output terminal 42 of the control unit 40. The operational amplifier 60 serves as a comparator which compares the voltage signal indicative of engine rotational speed N to the reference signal indicative of the predetermined engine rotational speed $N_{ref}$. The comparator 60 provides a high-level signal to the second output terminal 42 of the control unit 40 when engine rotational speed N is equal to or larger than the predetermined value $N_{ref}$. The predetermined value $N_{ref}$ is chosen so that the comparator 60 will discriminate whether or not engine rotational speed N is in a range in which the engine 10 is self-sustaining (self-moving). The comparator 60 provides a low-level signal to the second output terminal 42 when engine rotational speed N is lower than the predetermined value $N_{ref}$. Grounding lines in the control unit 40 and those of electromagnetic valves 19, 28, and 29 are omitted for the simplicity of illustration.

When the engine rotational speed N is equal to or higher than the predetermined value $N_{ref}$, the control unit 40 supplies a high-level signal to the control terminal of the electromagnetic valve 19 to open the latter. When the engine rotational speed N is lower than the predetermined value $N_{ref}$, the control unit 40 supplies a low-level signal to the electromagnetic valve 19 to close the latter. When the starter switch 53 closes, the switch 54 also closes and the control unit 40 supplies a high-level signal to the control terminal of the electromagnetic valve 28 to open the latter (provided that the ignition switch 71 is closed). When the starter switch 53 opens, the switch 54 also opens and the control unit 40 supplies a low-level signal to the electromagnetic valve 28 to close the latter. When the ignition switch 71 closes, the control unit 40 supplies a high-level signal to the electromagnetic valve 29 to open the latter. When the switch 71 opens, the control unit 40 supplies a low-level signal to the electromagnetic valve 29 to close the latter.

In operation, when the engine 10 operates under normal conditions in which engine rotational speed N is equal to or higher than the predetermined value $N_{ref}$, the starter switch 53 opens, and the ignition switch 71 closes; the control unit 40 opens the electromagnetic valves 19 and 29 and closes the electromagnetic valve 28. Thus, the fuel pump 18 supplies methanol from the fuel tank 16 to the fuel injection valve 15 via the passageway 17 and the electromagnetic valve 19 to inject methanol into the intake passageway 11. Methanol is therefore supplied to the combustion chamber 12 as fuel, with air. Meanwhile, methanol is transported by the pump 18 from the fuel tank 16 to the converter 21 via the passageways 17 and 22, and is heated by engine exhaust, thus being converted into a high-temperature gaseous mixture containing dimethyl ether. Heat required for this conversion is obtained predominantly from the exhaust heat of the engine 10, however an electric heater may be employed for heating. When the reaction temperature is 280° C. for example, gaseous mixture created in the converter 21 contains 10 mol % dimethyl ether, 40 mol % hydrogen, 20 mol % carbon hydroxide, 10 mol % water, 5 mol % un-reacted methanol, and others. The mixture of these ingredients is supplied via the passageway 23 to the cooling device 24 and is cooled by the device 24. Then, condensable ingredients, especially dimethyl ether, of the high-temperature gaseous mixture condense and separate from the gaseous fraction, the main ingredients of which are water and carbon monoxide. In this way, the cooling device 24 produces a liquid condensate containing dimethyl ether.

Figure 2:
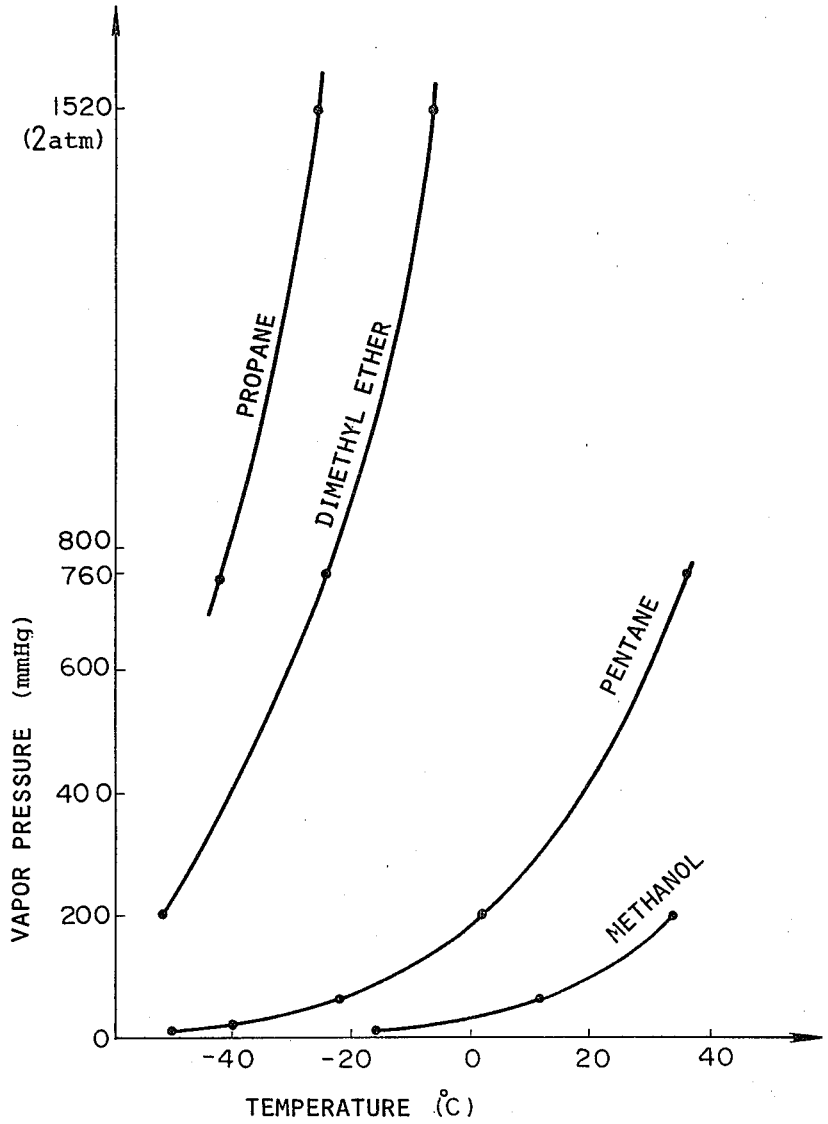
FIGS. 2 and 3 are graphs of the vapor pressures of several gases as a function of temperature.
Figure 3:
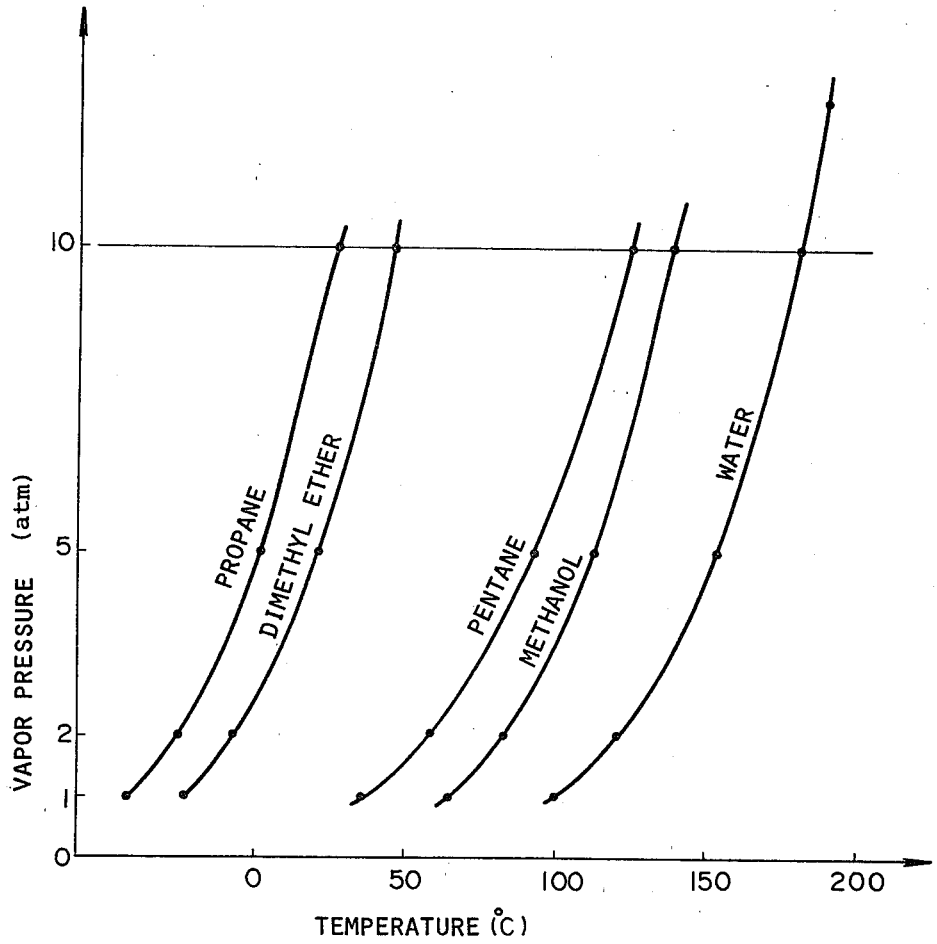

As illustrated in FIGS. 2 and 3, when the pressure is 10 atm, water, methanol, and dimethyl ether condense at temperatures of about 180° C., 140° C., and 46° C., respectively. Dimethyl ether is in the gaseous phase at normal temperatures and pressures, but changes to liquid phase when pressurized. The percentage of dimethyl ether in the liquid condensate is 60% by weight, or 40 mol %.

Under the normal running conditions of the engine 10, since the electromagnetic valve 29 is open and the electromagnetic valve 28 is closed, the liquid condensate provided by the cooling device 24 is transported through the passageway 26 to the sub-tank 25 and collects in the sub-tank 25. When the sub-tank 25 is fully filled with the liquid condensate, additional liquid is returned to the converter 21 via the overflow passageway 30 and check valve 31. The overflowing liquid condensate fuel may be supplied to the engine 10 via the fuel injection valve 15.

When the ignition switch 71 is closed to stop the engine 10, the control unit 40 closes the electromagnetic valve 29 to maintain pressure in the sub-tank 25 at a relatively high level. In this case, since engine rotational speed N is of course lower than the predetermined value $N_{ref}$ and the starter switch 53 is open, the control unit 40 also closes both the electromagnetic valves 19 and 28.

When the starter switch 53 is closed after closing the ignition switch 71 to start the engine 10, the control unit 40 opens both the electromagnetic valves 28 and 29 and keeps the electromagnetic valve 19 closed until engine rotational speed N reaches the predetermined value $N_{ref}$. As a result, only the liquid condensate containing dimethyl ether is supplied from the sub-tank 25 to the fuel injection valve 15 via the passageways 27 and 17 to be injected into the intake passageway 11. In this way, the supply of methanol to the engine 10 is interrupted while only the liquid condensate is supplied to the engine 10 as fuel.

Since liquid can be metered more accurately than gas by the fuel injection valve 15 which is conventionally controlled by electronic devices (not shown), the air-to-fuel ratio of mixture to the engine 10 can be controlled precisely at optimal values required to start the engine. As shown in FIGS. 2 and 3 dimethyl ether is much more volatile than methanol or pentane, the low boiling point ingredient of gasoline, and has about 600 mmHg vapor pressure at a temperature of −30° C., so that dimethyl ether is more easily combustible and the engine 10 can be easily started even under low-temperature conditions. As shown in FIGS. 2 and 3, since the vapor pressure of dimethyl ether is, for example, about one half of that of propane, high pressure rating is not required of the sub-tank 25. Since dimethyl ether has a calorific value of about 7,000 Kcal/Kg, even under low-temperature conditions its supply rate of about 0.4 cc/S is sufficient to start an automotive engine in the case of its total displacement of 2,000 cc. Thus, the volume of sub-tank 25 can be extremely small even if the need for more than one attempt to start is taken into account. During engine starting, both dimethyl ether and methanol may also be supplied to the engine.

When the engine rotational speed N rises to and beyond the predetermined value $N_{ref}$, the control unit 40 opens the electromagnetic valve 19 to supply methanol from the fuel tank 16 to the fuel injection valve 15. As a result, methanol is supplied to the engine. Since the predetermined engine rotational speed $N_{ref}$ provides an indication of whether or not the engine 10 has achieved the self-running condition, that is, the engine 10 start-up has been successful, the starter switch 53 is usually opened as soon as engine rotational speed N reaches the predetermined value $N_{ref}$. Therefore, just after engine starting, the control unit 40 usually closes the electromagnetic valve 28 to stop the supply of the liquid condensate from the sub-tank 25 to the fuel injection valve 15 and the engine 10. Thus, only methanol is supplied to the engine 10 while the liquid condensate required for the next engine starting begins to accumulate in the sub-tank 25.

It should be understood that further modifications and variations may be made in the present invention without departing from the spirit and scope of the present invention as set forth in the appended claims. For example, fuel is not limited to methanol, but may be other alcohol. Therefore, the highly-volatile liquid resulting from converting alcohol is not limited to dimethyl ether, but may be other substances.

What is claimed is:

1. An apparatus for starting an alcohol engine equipped with a starting motor, comprising:

(a) a converter supplied with alcohol for converting it into a high-temperature gaseous mixture containing a relatively highly volatile substance;

(b) a cooling device connected to the converter for receiving the high-temperature gaseous mixture and cooling it to produce a liquid condensate including the relatively highly volatile substance;

(c) a passageway connecting the cooling device to the engine for supplying the liquid condensate to the engine as fuel;

(d) a valve disposed in the passageway for selectively interrupting and effecting the supply of the liquid condensate to the engine;

(e) means for sensing whether the starting motor is in operation or at rest; and (f) means responsive to the sensed conditions of the starting motor for opening the valve to effect the supply of the liquid condensate to the engine when the starting motor is in operation and closing the valve to interrupt the supply of the liquid condensate to the engine when the starting motor is at rest.

2. An apparatus for starting an alcohol engine equipped with a starting motor, comprising:

(a) a converter supplied with alcohol for converting it into a high-temperature gaseous mixture containing a relatively highly volatile substance;
(b) a cooling device connected to the converter for receiving the high-temperature gaseous mixture and cooling it to produce a liquid condensate including the relatively highly volatile substance;
(c) a first passageway connecting the cooling device to the engine for supplying the liquid condensate to the engine as fuel;
(d) a first valve disposed in the first passageway for selectively interrupting and effecting the supply of the liquid condensate to the engine;
(e) means for sensing whether the starting motor is in operation or at rest;
(f) means responsive to the sensed conditions of the starting motor for opening the first valve to effect the supply of the liquid condensate to the engine when the starting motor is in operation and closing the first valve to interrupt the supply of the liquid condensate to the engine when the starting motor is at rest;
(g) a second passageway for supplying alcohol to the engine as fuel;
(h) a second valve disposed in the second passageway for selectively interrupting and effecting the supply of the alcohol to the engine;
(i) means for determining whether or not rotational speed of the engine is lower than a predetermined value; and
(j) means responsive to the determination as to the rotational speed of the engine for closing the second valve to interrupt the supply of the alcohol to the engine when the rotational speed of the engine is lower than the predetermined value and opening the second valve to effect the supply of the alcohol to the engine when the rotational speed of the engine is not lower than the predetermined value.

3. An apparatus as recited in claim 2, wherein the alcohol consists essentially of methanol.

4. An apparatus as recited in claim 2, the engine being equipped with an exhaust passageway, the converter being disposed in the exhaust passageway so as to be heated by engine exhaust gas.

5. An apparatus as recited in claim 2, wherein the determining means includes a crank angle sensor providing an alternating signal, the frequency of which is proportional to the rotational speed of the engine, a frequency-to-voltage converter connected to the crank angle sensor for receiving the alternating signal and producing a voltage signal, the magnitude of which is proportional to the rotational speed of the engine, and a comparator connected to the frequency-to-voltage convertor for receiving the voltage signal and comparing the latter to a preset constant voltage to produce a control signal indicative of whether or not the rotational speed of the engine is lower than the predetermined value defined by the preset voltage, the comparator being connected to the second valve to send the control signal to control the second valve.

6. An apparatus as recited in claim 3, wherein the relatively highly volatile substance consists essentially of dimethyl ether.

7. A method of starting an alcohol engine equipped with a starting motor, comprising the steps of:
(a) converting alcohol into a high-temperature gaseous mixture containing a relatively highly volatile substance;
(b) cooling the gaseous mixture to produce a liquid condensate including the relatively highly volatile substance;
(c) sensing whether or not the starting motor is in operation;
(d) supplying the liquid condensate to the engine as fuel when the starting motor is in operation.

8. A method as recited in claim 7, further comprising the steps of:
(e) determining whether or not the rotational speed of the engine is lower than a predetermined value;
(f) supplying alcohol to the engine as fuel when the rotational speed of the engine is not lower than the predetermined value.

9. A method as recited in claim 7, wherein the alcohol consists essentially of methanol.

10. A method as recited in claim 9, wherein the relatively highly volatile substance consists essentially of dimethyl ether.

11. An apparatus as recited in claim 1, wherein the cooling device is operative to produce the liquid condensate and the gaseous remainder from the gaseous mixture, and further comprising means for directly supplying the gaseous remainder to the engine as fuel.

12. An apparatus as recited in claim 11, wherein the gaseous-remainder supplying means includes a second passageway connecting the cooling device to the engine.

13. An apparatus as recited in claim 12, further comprising a valve disposed in the second passageway.

14. An apparatus as recited in claim 1, wherein the alcohol consists essentially of methanol.

15. An apparatus as recited in claim 1, the engine being equipped with an exhaust passageway, the converter being disposed in the exhaust passageway so as to be heated by engine exhaust gas.

* * * * *